United States Patent [19]

Welch

[11] 4,109,034

[45] Aug. 22, 1978

[54] METHOD OF AND APPARATUS FOR CONTROLLING THICKNESS OF COATING APPLIED TO MOVING FABRIC

[75] Inventor: Henry W. Welch, Lancaster, Pa.

[73] Assignee: Armstrong Cork Company, Lancaster, Pa.

[21] Appl. No.: 841,304

[22] Filed: Oct. 12, 1977

[51] Int. Cl.[2] ..... B05D 3/12

[52] U.S. Cl. ..... 427/355; 427/356; 427/358; 427/359; 118/414; 118/123; 118/118; 156/72

[58] Field of Search ..... 118/123, 414, 118, 413, 118/33; 156/72; 427/358, 359, 428, 365, 176, 356, 355

[56] References Cited

U.S. PATENT DOCUMENTS

| | | | |
|---|---|---|---|
| 2,069,322 | 2/1937 | Mellol | 427/213 |
| 3,007,205 | 11/1961 | House | 264/171 |

FOREIGN PATENT DOCUMENTS

| | | | |
|---|---|---|---|
| 29,785 | 7/1963 | Australia | 427/176 |

*Primary Examiner*—Michael F. Esposito
*Assistant Examiner*—Sam Silverberg

[57] ABSTRACT

A fabric to have a coating of controlled thickness applied to its upper surface moves between a supporting roll and a supporting plate. The lower surface of the fabric contacts the supporting roll and supporting plate but is unsupported therebetween. Between the supporting roll and plate, the moving fabric is depressed by a blade extending across its width. Near to the blade and between this blade and the supporting plate, a coating is applied to the upper surface of the fabric. A gauging device adjacent to where the coating is applied controls the thickness of the coating. The distance between the blade which depresses the fabric and the supporting plate should be several orders of magnitude greater than the distance between this blade and the gauging device. Any variations in fabric thickness as the fabric passes over the supporting plate would cause corresponding variations in the coating thickness if the coating were being applied over this plate. Controlling the coating thickness at the gauging device reduces the coating thickness variations which would occur if the coating were applied over the supporting plate by the factor of the distance between the blade which depresses the fabric and the gauging device divided by the distance between this blade and the supporting plate.

3 Claims, 1 Drawing Figure

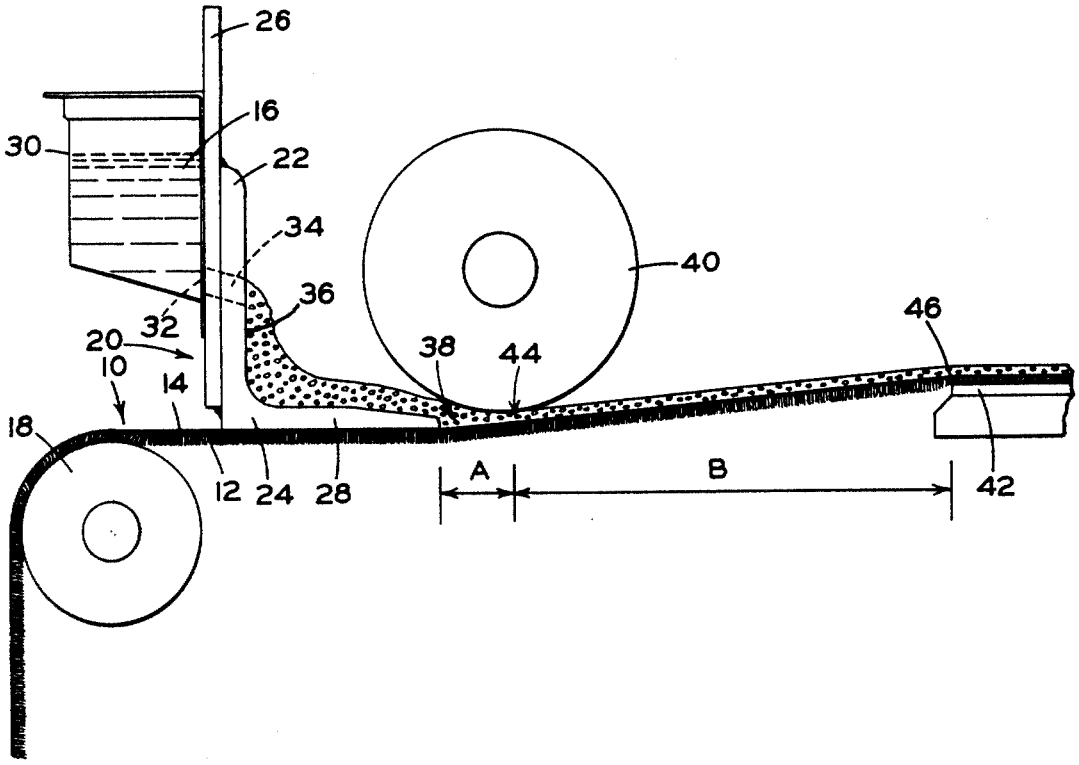
26
16
30
22
34
40
36
46
32
20
38
44
10
14
18
12
24
28
A
B
42

METHOD OF AND APPARATUS FOR CONTROLLING THICKNESS OF COATING APPLIED TO MOVING FABRIC

BACKGROUND OF THE INVENTION

1. Field of the Invention

This invention relates to a method of and apparatus for controlling the thickness of a coating applied to moving sheet material and, more particularly, to the method of and apparatus for controlling the thickness of a coating applied to the upper side of fabric moving between two points, the lower side of the fabric being unsupported therebetween.

2. Description of the Prior Art

U.S. Pat. No. 3,007,205 teaches a process of forming a cured foam rubber layer having a textile fabric embedded therein and shows an apparatus for carrying out this process. The fabric to be embedded in the foam layer enters a bank of foam at an angle to the horizontal, passes under a rotating guide roll positioned within the bank of foam, continues through the foam, and passes between a rotating doctor roll and a rotating endless belt supported thereunder by a supporting plate, the collection of the doctor roll and endless belt and supporting plate thereunder controlling the thickness of the foam rubber layer with the fabric embedded therein. In the method and apparatus of the invention described herein, the fabric to have a coating of controlled thickness on its one side does not enter into a bank of coating material at an angle to the horizontal and, in fact, does not even enter into a bank of coating material, does pass under a device the equivalent of a guide roll but such device is not positioned in a bank of coating material, does not continue through a bank of coating material but passes under a convenient reservoir of such material, and does not have the thickness of the coating material applied controlled while passing between a doctor roll and an endless belt supported thereunder by a plate but has the thickness of the coating material controlled by a thickness-controlling device positioned on the side of the fabric being coated while the opposite side of the fabric is unsupported thereunder.

U.S. Pat. No. 3,385,751 teaches a method of making tufted pile carpet wherein part of the method includes the forming of a plastic foam sheet with a reinforcing layer disposed within the sheet. The patent also shows the apparatus for carrying out this portion of the method. The reinforcing material to be disposed within the plastic foam sheet passes under a foam mixing head which dispenses foam onto a carrier belt, enters into and continues through the dispensed foam on the carrier belt, and passes between a carrier belt on the bottom and a cover belt on the top, both of which are backed up by metering rolls to control the thickness of the foam with the reinforcing layer of material therein. In the method and apparatus of the invention described herein, the fabric, to have a coating applied to its one side, the thickness of the coating being controlled, passes under a device which functions similarly to the bottom of the mixing head of the patent, but does not enter into the coating material immediately after this point or at any subsequent point, does therefore not continue to travel within the coating material but travels with the coating material on its one side, and does not have the thickness of the coating controlled by a pair of metering rolls, one above the coating material and one under the fabric, but has the thickness of the coating material controlled by a controlling device positioned above the coating with no supporting means under the fabric.

SUMMARY OF THE INVENTION

A fabric to have one side coated with a desired coating and the opposite side to remain uncoated passes over a roll with the side of the fabric to remain uncoated contacting the roll. The fabric then passes under a hold down means which contacts the side of the fabric to be coated and continues to travel until it passes over a support means which contacts the side of the fabric to remain uncoated. The fabric has no support under its side which remains uncoated as it travels between the roll and the support means.

The hold down means positioned intermediate the roll and the support means depresses the fabric across its width to a point below a plane through the uppermost point on the roll and support means where the fabric contacts the roll and support means. Adjacent the hold down means between the hold down means and the support means, a coating is applied onto the upper side of the moving fabric. A metering device positioned above the side of the fabric being coated controls the thickness of the applied coating across the fabric's width adjacent the coating application location.

The thickness of the applied coating is controlled by the distance the bottom of the metering device is spaced from the upper surface of the fabric being coated. Vertical movement of the upper surface of the fabric under the metering device will cause the thickness of the coating to vary. Such vertical movement at the metering device is caused by variations in the thickness of the fabric or variations on the uncoated side of the fabric as the fabric passes over the support means. By having the distance between the hold down means and the support means several orders of magnitude greater than the distance between the hold down means and the metering device, the vertical movement of the upper side of the moving fabric under the metering means caused by the vertical movement of the moving fabric over the support means is reduced by the factor of the distance between the hold down means and the metering device divided by the distance between the hold down means and the support means. This, therefore, gives good thickness control of the coating applied to the upper side of the moving fabric.

It is an object of the present invention to provide an apparatus for controlling the thickness of a coating applied to a moving fabric.

Another object of this invention is to provide an apparatus for controlling the thickness of a coating applied to the back side of a moving fabric.

A further object of this invention is to provide an apparatus for controlling the thickness of a coating applied to a moving carpet structure.

Another object of the present invention is to provide an apparatus for controlling the thickness of a foam coating applied to the back of a moving carpet structure.

Still another object of the present invention is to provide a method of controlling the thickness of a coating applied to a moving fabric.

Yet another object of the present invention is to provide a method of controlling the thickness of a coating applied to the back side of a moving fabric.

A further object of the present invention is to provide a method of controlling the thickness of a coating applied to a moving carpet structure.

A still further object of the present invention is to provide a method of controlling the thickness of a foam coating applied to the back of a moving carpet structure.

BRIEF DESCRIPTION OF THE DRAWING

The FIGURE is a diagrammatic of the method of and apparatus for controlling the thickness of a coating applied to moving fabric of this invention.

DESCRIPTION OF THE PREFERRED EMBODIMENT

As known to those skilled in the coating art, the present method and apparatus for controlling the thickness of coatings applied to fabrics, such as foam to carpet, rely upon gauging of the coating thickness by gauging this thickness over the combined thickness of the fabric and the coating at the location where the coating thickness is being controlled. This means that variations in fabric thickness result in variations in foam thickness, i.e., if the fabric is thicker, the coating thickness is thinner, and vice versa. This is undesirable, particularly for sculptured type carpet, since having increased coating thickness under those areas which are to be sculptured or lower than other areas on the surface of the carpet will tend to make these intended low areas to be increased in height so that some of the sculpturing effect is lost. This may also be undesirable when carpet tiles with a flat surface are being manufactured. Flat surfaced carpet tiles which have been manufactured by gauging the foam thickness from the overall thickness of the carpet tile may appear to present a monolithic appearance when installed. However, a problem arises when the coating thickness of two adjacent carpet tiles varies and a person is walking across the carpet tiles from the carpet tile which has the thinner coating thickness toward the carpet tile which has a thicker coating thickness. Since shoe pressure on the carpet tile having the thinner coating thickness will depress the carpet as it is walked upon, there is the possibility of the tip of the shoe or the heel of the shoe catching on the edge of the carpet tile having the thicker coating thickness. Such action over a period of time will tend to destroy the desired monolithic design effect. Also, having less variation in the coating thickness applied to fabric will have definite economic advantages because of the reduced amount of coating material being used.

A carpet 10 having a face side 12 and a back side 14 is to have a coating material 16 applied to the back side 14 of the carpet 10. The carpet passes over a first supporting means, roll 18, with its face side 12 contacting the surface of roll 18. As the carpet continues to move, it passes under a hold down means 20 which is formed by welding the one leg 22 of angle iron 24 to a piece of bar steel 26. The other leg 28 of angle iron 24 is positioned horizontally across the width of the carpet 10. As the carpet passes under leg 28 of angle iron 24, the back side 14 of carpet 10 contacts the under side of leg 28 of angle iron 24. Other conventionally known hold down means 20 could be used in place of the angle iron 24 and bar stock 26 to serve the same purpose.

The coating material 16 in this example is a conventional foam used on the back side 14 of various forms of carpet 10. The coating material passes from any conventional storage means such as storage tank 30 through an opening 32 in its side and near its bottom, through an opening 34 in the bar stock 26 and leg 22 of angle iron 24, down the inner surface 36 of angle iron 24 to the point of application 38 of the coating material 16 onto the back side 14 of the carpet 10. The storage tank 30 extends across the width of the carpet 10 being coated. The opening 32 is not one opening but is a series of openings along the side of the storage tank 30 near its bottom. Also, the opening 34 through the bar stock 26 and angle iron 24 is not one opening but is a series of openings which correspond to and are aligned with the openings 32 of the storage tank 30. Since the angle iron 24 extends across the width of the fabric being coated, the point of application 38 of the foam coating 16 on the back 14 of carpet 10 is really not a point but a line of application across the width of the fabric being coated.

The carpet continues its travel under a coating thickness controlling device, such as roll 40 in this example. Any conventional gauging, metering, or thickness controlling devices known to those skilled in the coating art could be used to control the thickness of coating 16. The carpet continues to move onto and over a second support means such as plate 42 in this example. Any conventional material in plate form which will not cause damage to the carpet face 12 can be used as the supporting means. Also, any conventionally known supporting means other than a plate could be used at this point.

As the carpet passes out from under the leg 28 of angle iron 24, the point of application 38 of the foam coating 16, the foam coating 16 is applied to the back side 14 of the carpet. Again, the point of application of the foam is a line across the entire width of the fabric.

The carpet moves a short distance A from the point of application 38 of the foam coating to the point of thickness control 44 of the foam coating; the point of thickness control 44, like the point of application 38, is also a line across the width of the fabric. As the carpet 10 moves under the point of thickness control 44, the applied foam is gauged to its correct thickness. The carpet with the controlled thickness of foam coating thereon then travels from the point of thickness control 44 to the first support point 46 of supporting plate 42. This distance is designated distance B.

As the carpet moves between roll 18 and supporting means 42, it is unsupported thereunder on its face side 12. The coating application point 38 is lower than a plane through the back side 14 of the carpet opposite where its face last contacts the surface of roll 18 and the back side 14 of the carpet opposite where its face first touches the supporting plate 42. This point of application 38 across the carpet, therefore, provides a reference in relation to the back surface 14 of carpet 10 from which the thickness of the foam coating 16 can be controlled.

Although the point of application 38 serves as a reference for the controlling of the thickness of the foam under roll 40, the foam thickness controlled at the point of thickness control 44 is still somewhat dependent on the thickness variations of the fabric since the fabric is passing over the supporting plate 42. However, to decrease the effect of these variations of fabric thickness as the carpet passes over the supporting plate 42 at supporting point 46, the distance A plus B should be made several orders of magnitude, at least two, greater than the distance A since the vertical variation at point 44 is determined by multiplying the vertical variation at point 46 by the factor A/(A + B). In this example, if $A = 1$ unit and $A + B =$ approximately 9 units, then the factor A/(A + B) in this example is approximately 1/9. Therefore, in this example, the vertical variations of the carpet at point 44 are approximately 1/9 times any vertical variations at point 46. The greater the distance A + B in relation to the distance A, the less will be the effect of the vertical variations at point 46 caused by fabric thickness variations or any other such variations on the vertical variations at point 44. This, in turn, means a better control in the thickness of the foam coating 16 at point 44 and, therefore, a more uniform foam coating on the back side 14 of carpet 10. This more uniform coating will overcome many of the problems of uneven or ununiform coating on the back of carpet caused by metering the foam onto the back of the carpet by gauging the thickness of the foam off of the face of the carpet or, stated another way, off the total thickness of the carpet fabric and foam.

What is claimed is:

1. A method of controlling the thickness of a coating applied to moving fabric comprising the steps of:

(a) providing a fabric to be coated on one side, (b) moving said fabric between a first point and a second point with the side of said fabric to be coated facing up, said fabric having no support under its lower side as it moves between said first and second points, (c) depressing said moving fabric across its width at a point intermediate said first and second points so that the upper side of the fabric at said intermediate point is below a plane through said first and second points, (d) applying a coating onto the upper side of said moving fabric adjacent said intermediate point between said intermediate point and said second point, while said moving fabric remains depressed at said intermediate point, and (e) controlling the thickness of the applied coating across the fabric's width at a point adjacent the coating application location such that the distance between the intermediate point and the second point is several orders magnitude greater than the distance between the intermediate point and the point where the thickness is being controlled.

2. The method of claim 1 wherein the fabric comprises carpet and the side of the carpet to be coated is the back side.

3. The method of claim 1 wherein the step of depressing said moving fabric across its width at a point intermediate said first and second points is carried out at an intermediate point closer to said first point than to said second point.

* * * * *